US007484576B2

(12) United States Patent
Hall et al.

(10) Patent No.: US 7,484,576 B2
(45) Date of Patent: Feb. 3, 2009

(54) JACK ELEMENT IN COMMUNICATION WITH AN ELECTRIC MOTOR AND OR GENERATOR

(76) Inventors: David R. Hall, 2185 S. Larsen Pkwy., Provo, UT (US) 84606; Tyson J. Wilde, 2185 S. Larsen Pkwy., Provo, UT (US) 84606; Ben Miskin, 2185 S. Larsen Pkwy., Provo, UT (US) 84606

( * ) Notice: Subject to any disclaimer, the term of this patent is extended or adjusted under 35 U.S.C. 154(b) by 66 days.

(21) Appl. No.: 11/673,872

(22) Filed: Feb. 12, 2007

(65) Prior Publication Data

US 2007/0221417 A1 Sep. 27, 2007

Related U.S. Application Data

(63) Continuation-in-part of application No. 11/611,310, filed on Dec. 15, 2006, and a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837.

(51) Int. Cl.
*E21B 7/04* (2006.01)
*E21B 10/00* (2006.01)

(52) U.S. Cl. ..... 175/73; 175/104; 175/327

(58) Field of Classification Search ..... 175/327, 175/40, 73, 104, 105
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford |
| 1,821,474 | A | 9/1931 | Mercer |
| 1,879,177 | A | 9/1932 | Gault |
| 2,054,255 | A | 9/1936 | Howard |
| 2,064,255 | A | 12/1936 | Garfield |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |

(Continued)

*Primary Examiner*—Hoang Dang
(74) *Attorney, Agent, or Firm*—Tyson J. Wilde

(57) ABSTRACT

A drill bit has a body intermediate a shank and a working face and has an axis of rotation. The working face has at least one cutting element and the body has at least a portion of a jack assembly. The jack assembly has at least a portion of a shaft disposed within a cavity formed in the body of the drill bit, the shaft having a distal end extending from an opening of the cavity formed in the working face. The jack assembly also has an electric motor and/or generator.

19 Claims, 10 Drawing Sheets

U.S. PATENT DOCUMENTS 2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,036,645 A * 5/1962 Rowley ..... 175/93
3,135,341 A 6/1964 Ritter
3,294,186 A 12/1966 Buell
3,301,339 A 1/1967 Pennebaker
3,379,264 A 4/1968 Cox
3,429,390 A 2/1969 Bennett
3,493,165 A 2/1970 Schonfield
3,583,504 A 6/1971 Aalund
3,732,143 A * 5/1973 Joosse ..... 175/6
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau et al.
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,924,499 A * 7/1999 Birchak et al. ..... 175/40
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
9,629,076 4/2005 Fanuel
6,953,096 B2 10/2005 Glenhill
2003/0213621 A1 11/2003 Britten
2004/0238221 A1 12/2004 Runia
2004/0256155 A1 12/2004 Kriesels

* cited by examiner

JACK ELEMENT IN COMMUNICATION WITH AN ELECTRIC MOTOR AND OR GENERATOR

CROSS REFERENCE TO RELATED APPLICATIONS

This patent application is a continuation-in-part of U.S. patent application Ser. No. 11/611,310 filed on Dec. 15, 2006 and which is entitled System for Steering a Drill String. This patent application is also a continuation-in-part of U.S. patent application Ser. No. 11/278,935 filed on Apr. 6, 2006 now U.S. Pat. No. 7,426,968 and which is entitled Drill Bit Assembly with a Probe. U.S. patent application Ser. No. 11/278,935 is a continuation-in-part of U.S. patent application Ser. No. 11/277,394, now U.S. Pat. No. 7,398,837, which filed on Mar. 24, 2006 and entitled Drill Bit Assembly with a Logging Device. U.S. patent application Ser. No. 11/277,394 is a continuation-in-part of U.S. patent application Ser. No. 11/277,380, now U.S. Pat. No. 7,337,858, also filed on Mar. 24, 2006 and entitled A Drill Bit Assembly Adapted to Provide Power Downhole. U.S. patent application Ser. No. 11/277,380 is a continuation-in-part of U.S. patent application Ser. No. 11/306,976, now U.S. Pat. No. 7,360,610, which was filed on Jan. 18, 2006 and entitled "Drill Bit Assembly for Directional Drilling." U.S. patent application Ser. No. 11/306,976 is a continuation-in-part of 11/306,307, now U.S. Pat. No. 7,225,886, filed on Dec. 22, 2005, entitled Drill Bit Assembly with an Indenting Member. U.S. patent application Ser. No. 11/306,307 is a continuation-in-part of U.S. patent application Ser. No. 11/306,022, now U.S. Pat. No. 7,198,119, filed on Dec. 14, 2005, entitled Hydraulic Drill Bit Assembly. U.S. patent application Ser. No. 11/306,022 is a continuation-in-part of U.S. patent application Ser. No. 11/164,391, now U.S. Pat. No. 7,270,196, filed on Nov. 21, 2005, which is entitled Drill Bit Assembly. All of these applications are herein incorporated by reference in their entirety.

BACKGROUND OF THE INVENTION

This invention relates to drill bits, specifically drill bit assemblies for use in oil, gas, horizontal and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit whirl in hard formations may result in damage to the drill bit and reduce penetration rates. Further, loading too much weight on the drill bit when drilling through a hard formation may exceed the bit's capabilities and also result in damage. Too often unexpected hard formations are encountered suddenly and damage to the drill bit occurs before the weight on the drill bit may be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

A drill bit has a body intermediate a shank and a working face and has an axis of rotation. The working face has at least one cutting element and the body has at least a portion of a jack assembly. The jack assembly has at least a portion of a shaft disposed within a cavity formed in the body of the drill bit, the shaft having a distal end extending from an opening of the cavity formed in the working face. The jack assembly also has an electric motor.

The bit may be a shear bit, a percussion bit, or a roller cone bit. The cavity may allow passage of drilling fluid. The shaft may be rotationally isolated from the drill bit. The shaft may be coaxial with the axis of rotation. A seal may be disposed around the shaft and in the opening of the cavity formed in the working face.

The jack assembly may comprise a spring connected to the shaft and the electric motor may be in mechanical communication with the spring. The electric motor may be adapted to change the compression of the spring. The electric motor may be a stepper motor. The electric motor may be an AC motor, a universal motor, a three-phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly-fed motor, or combinations thereof. The shaft may be in mechanical communication with the electric motor. The electric motor may be adapted to axially displace the shaft.

At least a portion of the electric motor may be disposed within the chamber. The electric motor may be in communication with a downhole telemetry system. The electric motor may be adapted to counter rotate the shaft with respect to the rotation of the bit.

The electric motor may be in communication with electronic equipment disposed within a bottom hole assembly. The electronic equipment may comprise sensors. The electric motor may be part of a closed-loop system adapted to control the orientation of the shaft. The electric motor may be powered by a turbine, a generator, a flywheel energy storage device, a battery, or a power transmission system from the surface or downhole.

The distal end of the shaft may comprise a bias adapted to steer a tool string connected to the drill bit. The distal end may comprise a hard material selected from the group consisting of polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond, cubic boron nitride, chromium, titanium, matrix, diamond impregnated matrix, diamond impregnated carbide, a cemented metal carbide, tungsten carbide, niobium, or combinations thereof.

DETAILED DESCRIPTION OF THE INVENTION AND THE PREFERRED EMBODIMENT

Figure 1:
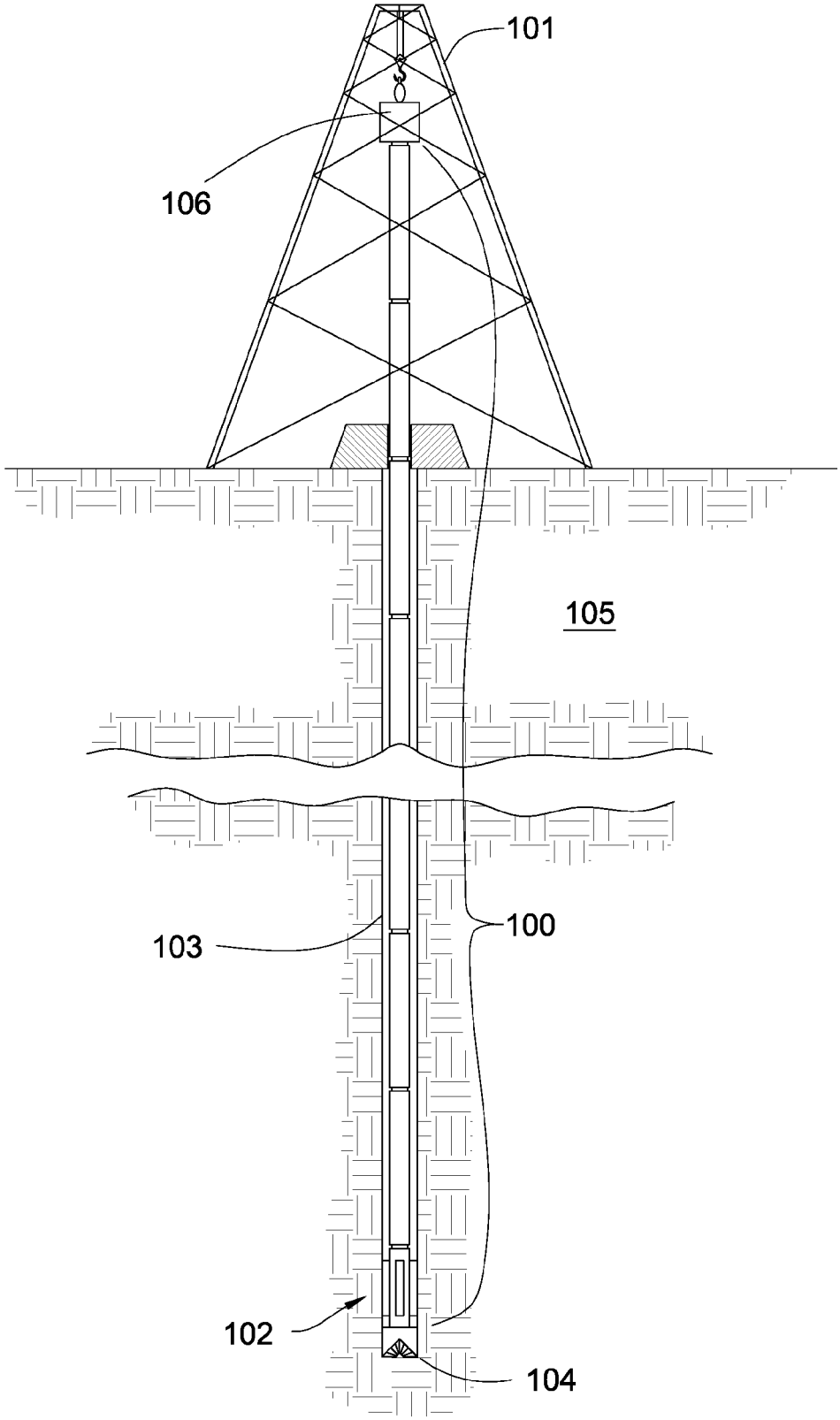
FIG. 1 is a cross-sectional diagram of an embodiment of a tool string suspended in a bore hole.

FIG. 1 is an embodiment of a tool string 100 suspended by a derrick 101. A bottom-hole assembly 102 is located at the bottom of a bore hole 103 and comprises a drill bit 104. As the drill bit 104 rotates downhole the tool string 100 advances farther into the earth. The tool string may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. A preferred data transmission system is disclosed in U.S. Pat. No. 6,670,880 to Hall, which is herein incorporated by reference for all that it discloses. However, in some embodiments, the no telemetry system is used. Mud pulse, short hop, or EM telemetry systems may also be used with the present invention.

Figure 2:
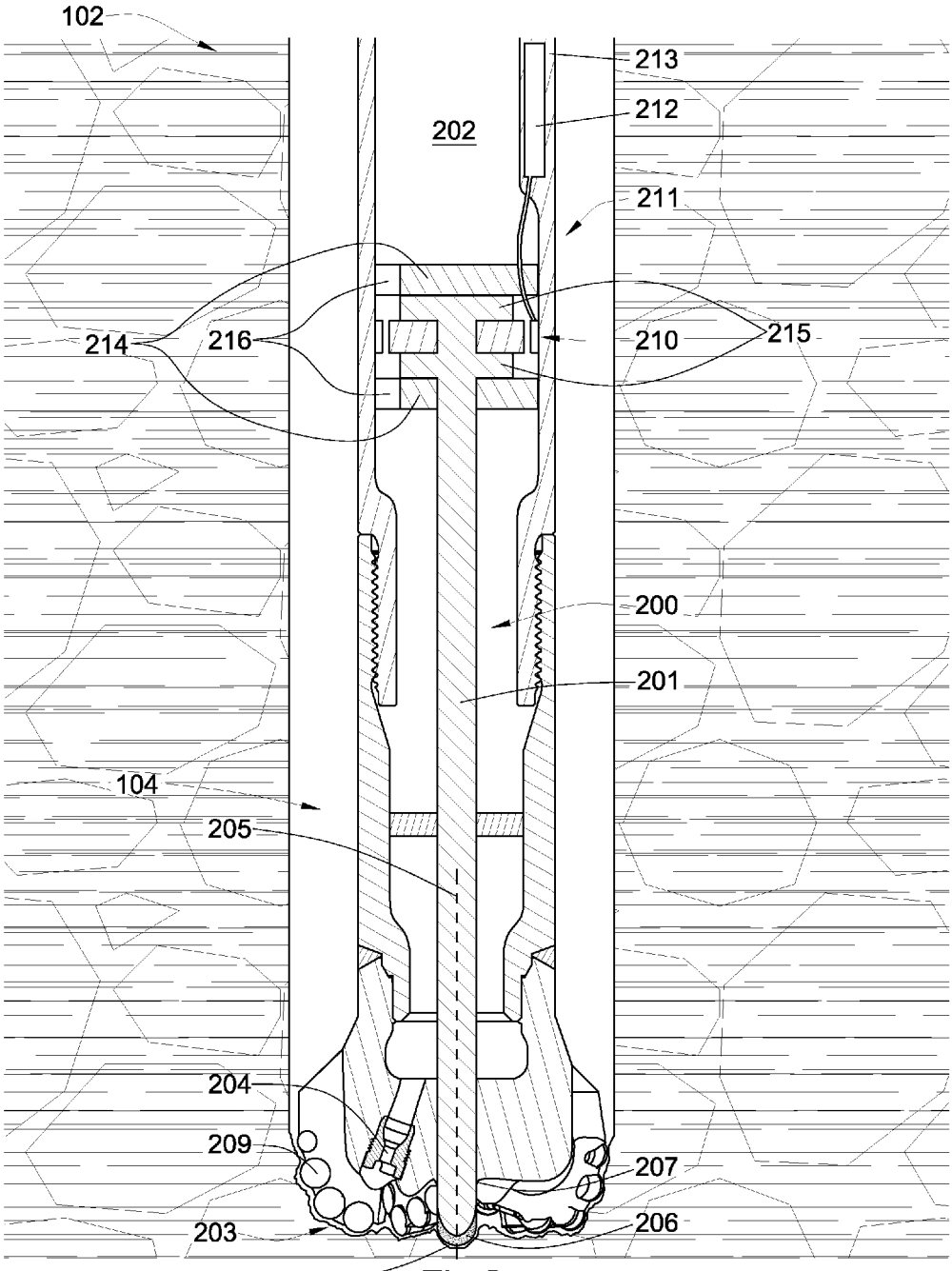
FIG. 2 is a cross-sectional diagram of an embodiment of a bottom-hole assembly.

As in the embodiment of FIG. 2, the bottom hole assembly 102 comprises a jack assembly 200 in a shear bit. The jack assembly 200 comprises a shaft 201, with at least a portion of the shaft being disposed within a cavity armed in the body of the drill bit 104. In this embodiment, the cavity is a bore 202 in the bottom-hole assembly 102 which passes drilling fluid through a drill string. The drill bit 104 may comprise nozzles 204 which emit streams of drilling fluid in order to clean and cool the working face 203 of the drill bit.

The shaft 201 may be coaxial with an axis of rotation 205 of the drill bit 104 and comprises a distal end 206 which extends from an opening 207 of the bore 202 formed in the working face 203. The distal end 206 may stabilize the drill bit by indenting into a profile of the formation caused by the shape of the working face 203. The jack element may also reduce wear on cutting elements 209 of the working face 203 by compressively failing the formation at the indention 208 and thereby weakening the formation. Preferably, the distal end 206 may comprise a hard material selected from the group consisting of polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond, cubic boron nitride, chromium, titanium, matrix, diamond impregnated matrix, diamond impregnated carbide, a cemented metal carbide, tungsten carbide, niobium, or combinations thereof.

The jack assembly 200 also comprises an electric motor 210. The motor 210 may be disposed within a tool string component 211 adjacent the drill bit 104. The motor 210 may be a stepper motor, though the motor may also be an AC motor, a universal motor, a three-phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly-fed motor, or combinations thereof.

The motor 210 may be powered by a battery 212 disposed proximate or within a bore wall 213 of the component 211. The shaft 201 may be attached to the motor 210 such that as the motor 210 rotates, the shaft 201 is also rotated. In some embodiments, the jack element may be counter rotated with respect to the drill bit 104 which may allow the shaft 201 to remain generally rotationally stationary with respect to the formation. In other embodiments, the motor may decrease or increase the speed of the jack element in either a clockwise or counterclockwise direction.

The shaft 201 may be centered in the bore 202 by a plurality of support elements 214, which may be brazed, glued, bolted, fastened, or compressively fixed to the bore wall 213 of the component 211 or drill bit 104, or they may be disposed within recesses formed in the bore wall 213. The shaft 201 may comprise a plurality of flanges 215 which abut the support elements 214 and prevent the shaft 201 from moving axially. The support elements 214 may comprise bearing surfaces where the support elements 214 contact the shaft 201. The bearing surfaces may reduce friction between the shaft 201 and support elements 214, allowing the shaft 201 to rotate more easily, which may reduce wear or may also reduce the amount of power drawn from the battery 212 by the motor 210. The support elements 214 may also comprise a plurality of openings 216 to allow drilling fluid to pass. In some embodiments, the support elements may comprise a magnetic field which is adapted to repel the flanges of the shaft to help prevent wear.

Figure 3:
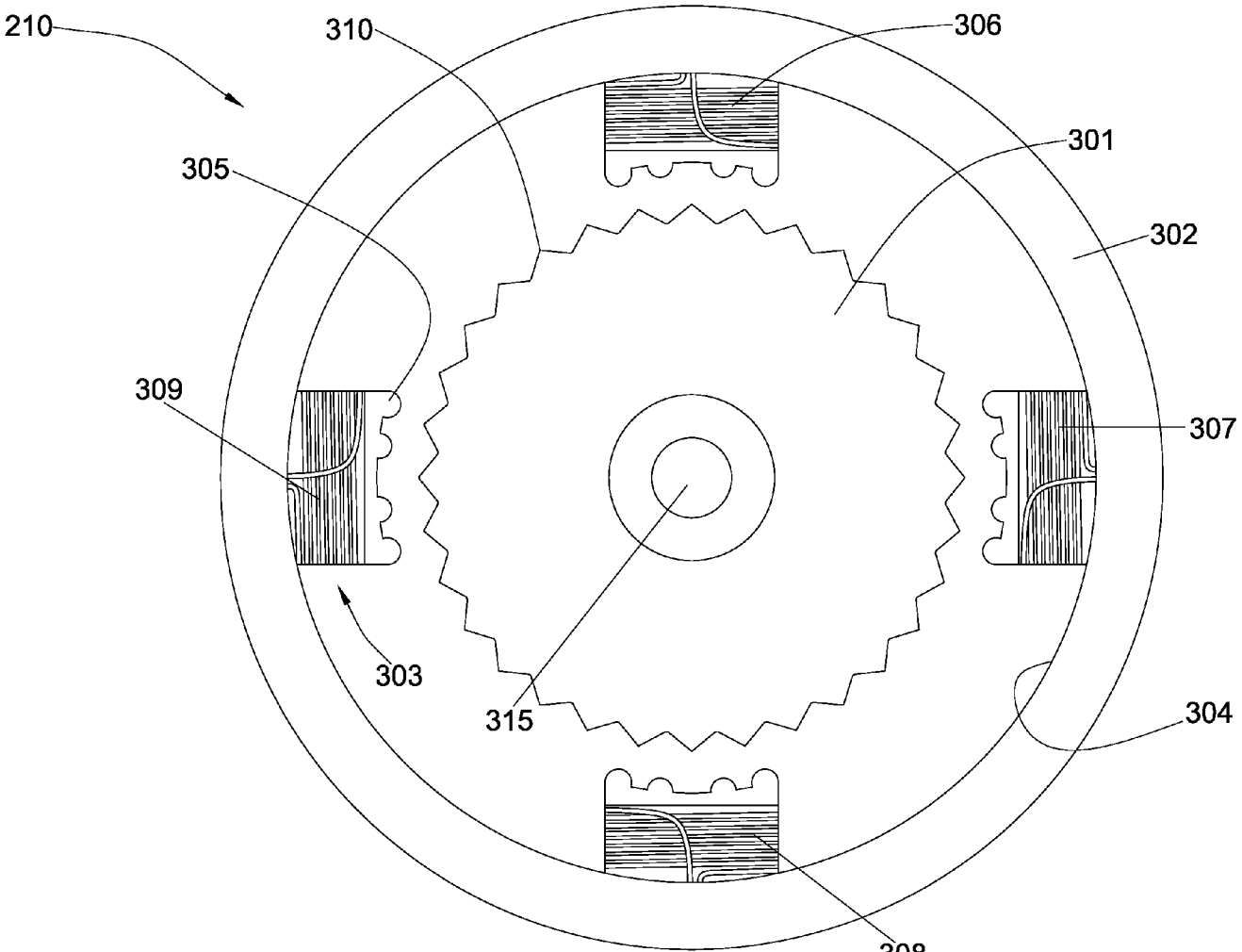
FIG. 3 is a cross-sectional diagram of an embodiment of a stepper motor.

The electric motor 210 may be a stepper motor, as in the embodiment of FIG. 3. The motor 210 may comprise a central gear 301 disposed within an outer ring 302, the central gear 301 may comprise a magnetically attractive metal. The outer ring 302 may comprise a plurality of electrically controlled magnets 303 disposed along an inner diameter 304 and surrounding the central gear 301. The magnets 303 may be in electrical communication with the battery 212 or other power source.

The magnets 303 may comprise a plurality of protruding lobes 305, such that when a first magnet 306 is turned on, a plurality of teeth 310 disposed along an outer diameter 320 of the gear 301 are aligned with the lobes 305 of the first magnet 306 such that each lobe 305 attracts a tooth 310 nearby. The first magnet 306 is turned off and a second magnet 307 is turned on, which causes the central gear 301 to rotate clockwise until another plurality of teeth 310 are aligned with the lobes 305 of the second magnet 307. The second magnet 307 is turned off and a third magnet 308 is turned on, causing the central gear 301 to rotate clockwise until another plurality of teeth 310 are aligned with the lobes 305 of the third magnet 308. Similarly, the third magnet 308 turns off and a fourth magnet 309 turns on, causing the central gear 301 to rotate clockwise until another plurality of teeth 310 are aligned with the lobes 305 of the fourth magnet 309. The fourth magnet 309 is turned off and the first magnet 306 is turned on again, rotating the central gear 301 clockwise again. In this manner, the gear 301 is rotated clockwise one tooth 310. In order to rotate the gear 301 at a high speed, the magnets 303 may cycle on and off at a high rate. A greater number of teeth 310 and a smaller gap between each lobe 305 of the magnets 303 would cause the gear 301 to rotate more slowly, whereas a smaller number of teeth 310 and a larger gap between lobes 305 would cause the gear 301 to rotate more quickly.

The gear 301 may comprise a central hole 315 wherein the shaft 201 may be disposed or interlocked to. The gear 301 may be attached to the shaft 201 such that as the gear 301 is rotated by the magnets 303, the shaft 201 is rotated also. The gear 301 may also be formed in a portion of the shaft 201.

Figure 4:
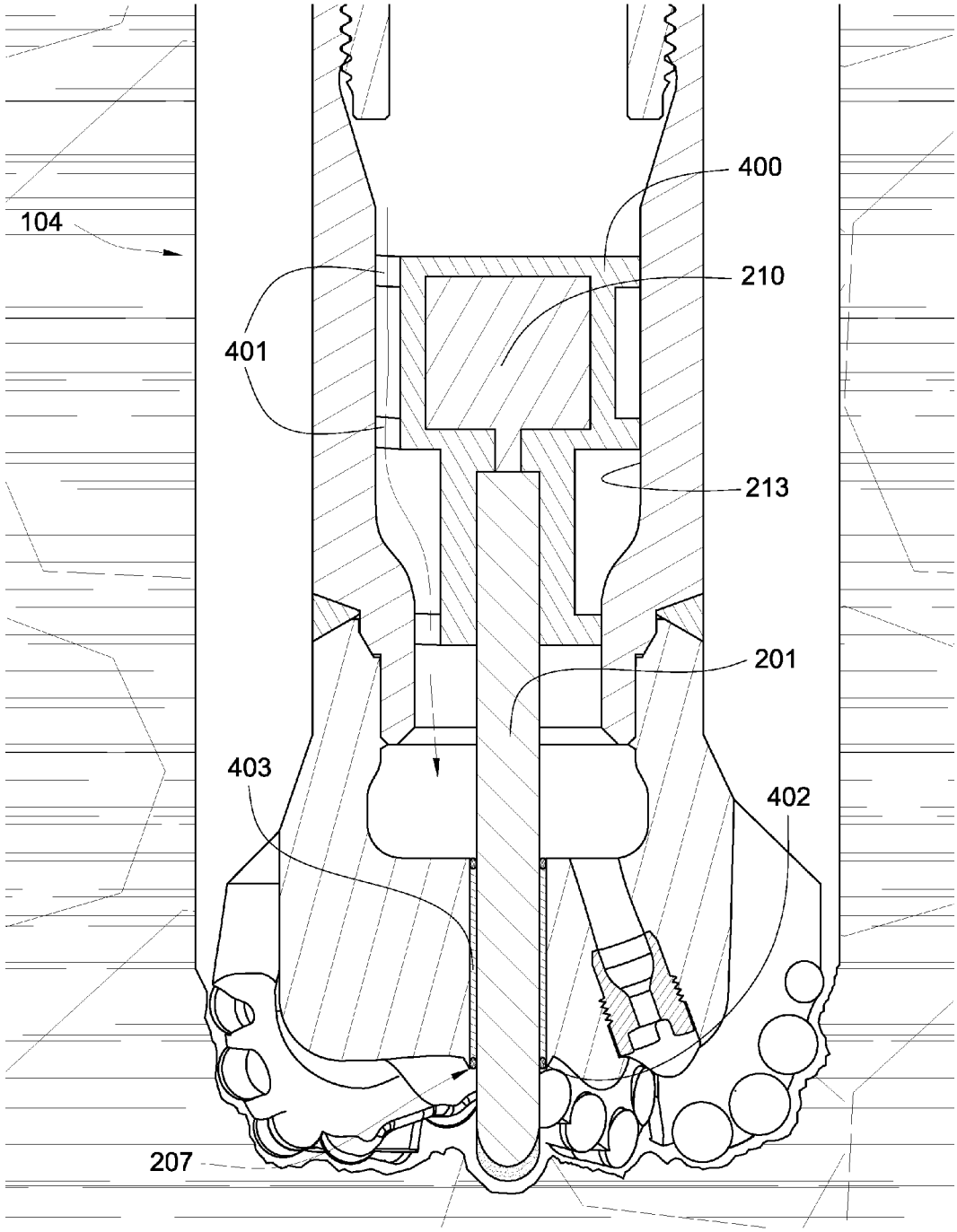
FIG. 4 is a cross-sectional diagram of an embodiment of a drill bit.

Referring to the embodiment of FIG. 4, the electric motor 210 may be disposed within the drill bit 104. The motor 210 may be disposed within a casing 400 secured to the bore wall 213 of the drill bit 104. A portion of the shaft 201 may also be disposed within the casing 400 to provide support for the shaft 201. The casing 400 may comprise a plurality of openings 401 which allow drilling fluid to pass.

The opening 207 in the working face 203 through which the shaft 201 protrudes may comprise at least one seal 402, such as an o-ring, to prevent fluid and cuttings from entering the opening 207, since cuttings in the opening 207 may impede rotational movement of the shaft 201. The opening 207 may also comprise a bearing surface 403, which may reduce friction and wear on the opening 207 and shaft 201.

Figure 5:
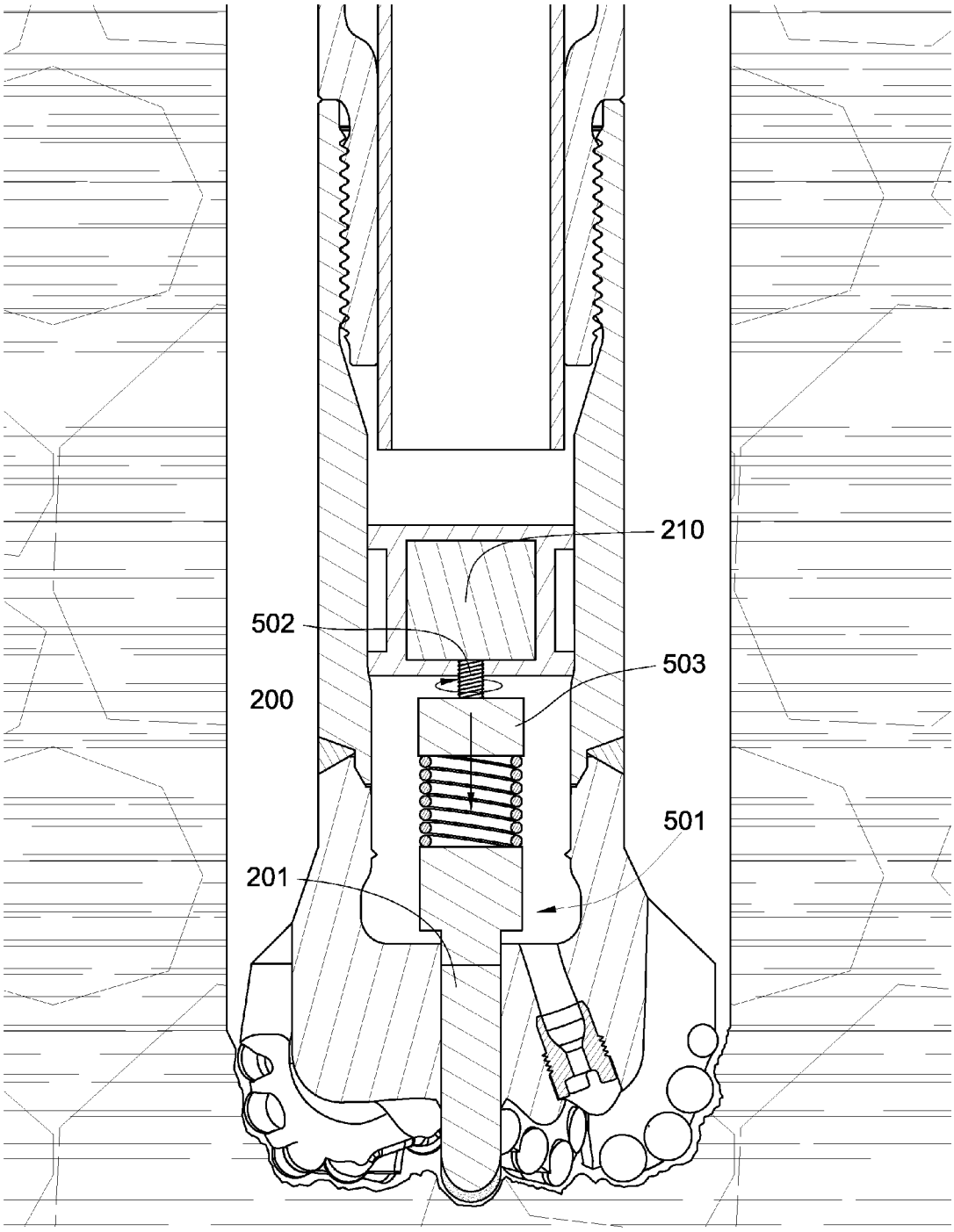
FIG. 5 is a cross-sectional diagram of another embodiment of a drill bit.

The shaft may be spring loaded, as in the embodiment of FIG. 5. The electric motor 210 may be adapted to axially displace the shaft 201. The jack assembly 200 may comprise a spring 500 intermediate the electric motor 210 and the shaft 201. The shaft 201 may comprise a proximal end 501 with a larger diameter than the distal end 206 such that the proximal end 501 has a larger surface area to contact the spring 500.

The electric motor 210 may comprise a threaded pin 502 which extends or retracts with respect to the motor 210 according to the direction of rotation of the motor 210. The jack assembly 200 may also comprise an element 503 intermediate the threaded pin 502 and the spring 500. The intermediate element 503 may be attached to either the threaded pin 502 or the spring 500 such that as the threaded pin 502 rotates downward the spring 500 is compressed, exerting a greater downward force on the shaft 201. On the other hand, the motor may rotate in the opposite direction, relieving the compression on the spring and exerting a lesser downward force on the shaft 201. The motor 210 may be adapted to rotate the threaded pin 502 quickly in both directions to create an oscillating force on the spring 500, allowing the shaft 201 to be axially displaced rapidly in both directions while the bit is in operation. The proximal end 501 of the shaft 201 may also act as an anchor to prevent the shaft 201 from extending too far from the working face 203.

Figure 6:
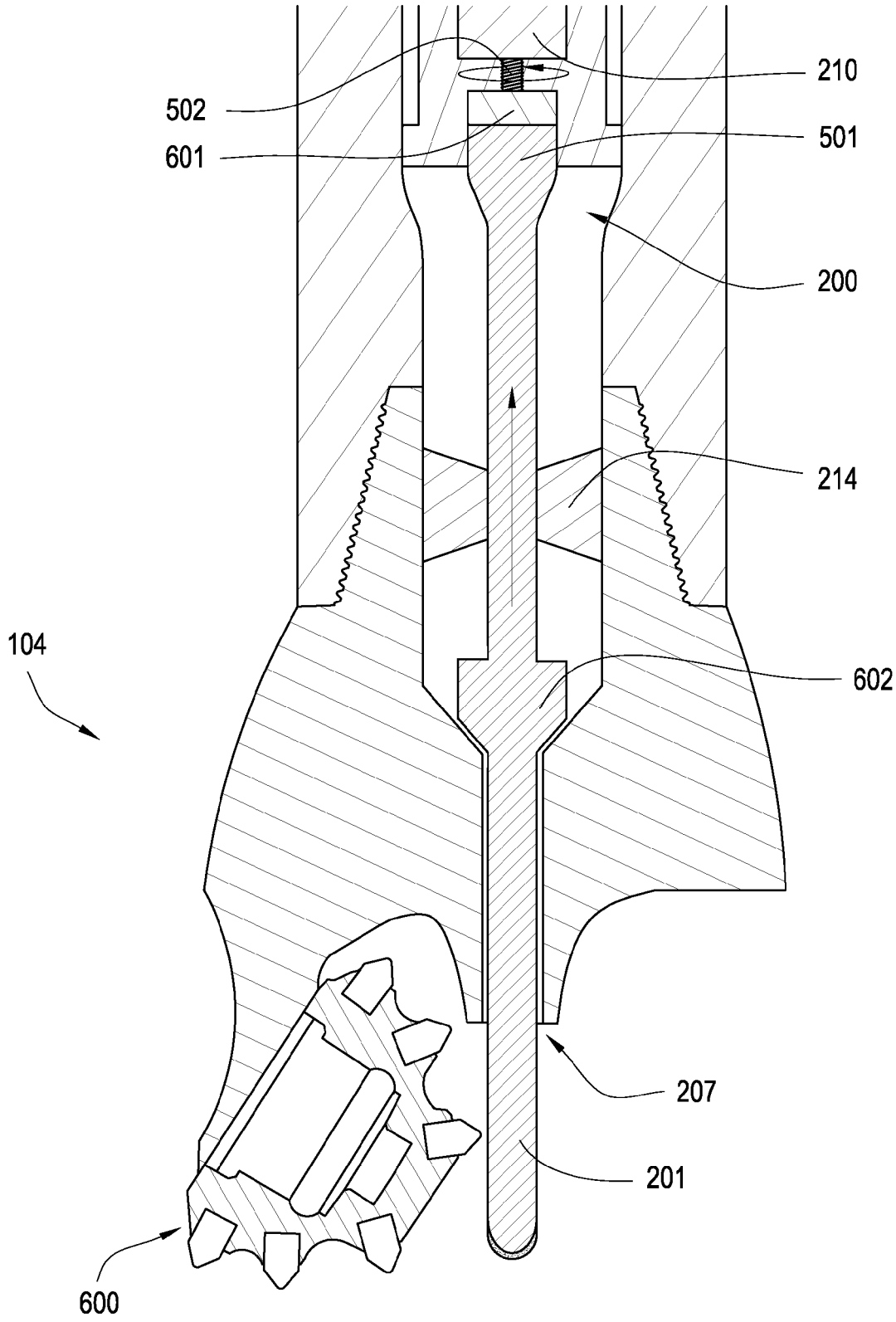
FIG. 6 is a cross-sectional diagram of another embodiment of a bottom-hole assembly.

The drill bit 104 may be a roller cone bit, as in the embodiment of FIG. 6. The jack assembly 200 may comprise a shaft 201 extending from the opening 207 and between the roller cones 600. The electric motor 210 may comprise a threaded pin 502 which extends or retracts with respect to the motor 210 according to the direction of rotation of the motor 210. The jack assembly 200 may also comprise an element 601 intermediate the shaft 201 and the threaded pin 502, with the intermediate element 601 being affixed to the threaded shaft 502 such that the intermediate element 601 directly contacts the proximal end 501 of the shaft 201. As the threaded shaft 502 rotates counter-clockwise it also translates upward, allowing for the shaft 201 to translate upward due to the force from the formation. The shaft 201 may comprise a tapered portion 602 that acts as an anchor. The motor 210 may be adapted to change its direction of rotation quickly in order to create an oscillating force on the shaft 201. The jack assembly 200 may also comprise support elements 214 in the bore of the drill bit 104. In some embodiments, a cam is disposed between the motor and the shaft, such that as the motor rotates, the cam vibrates the shaft aiding in failing downhole formations. A cam assembly that may be compatible with the present invention is disclosed within U.S. patent application Ser. No. 11/555,334, now U.S. Publication No. 2008/0099245, filed on Nov. 1, 2006 and entitled Cam Assembly in a Downhole Component. The U.S. patent application Ser. No. 11/555,334 is herein incorporated by reference for all that it contains.

Figure 7:
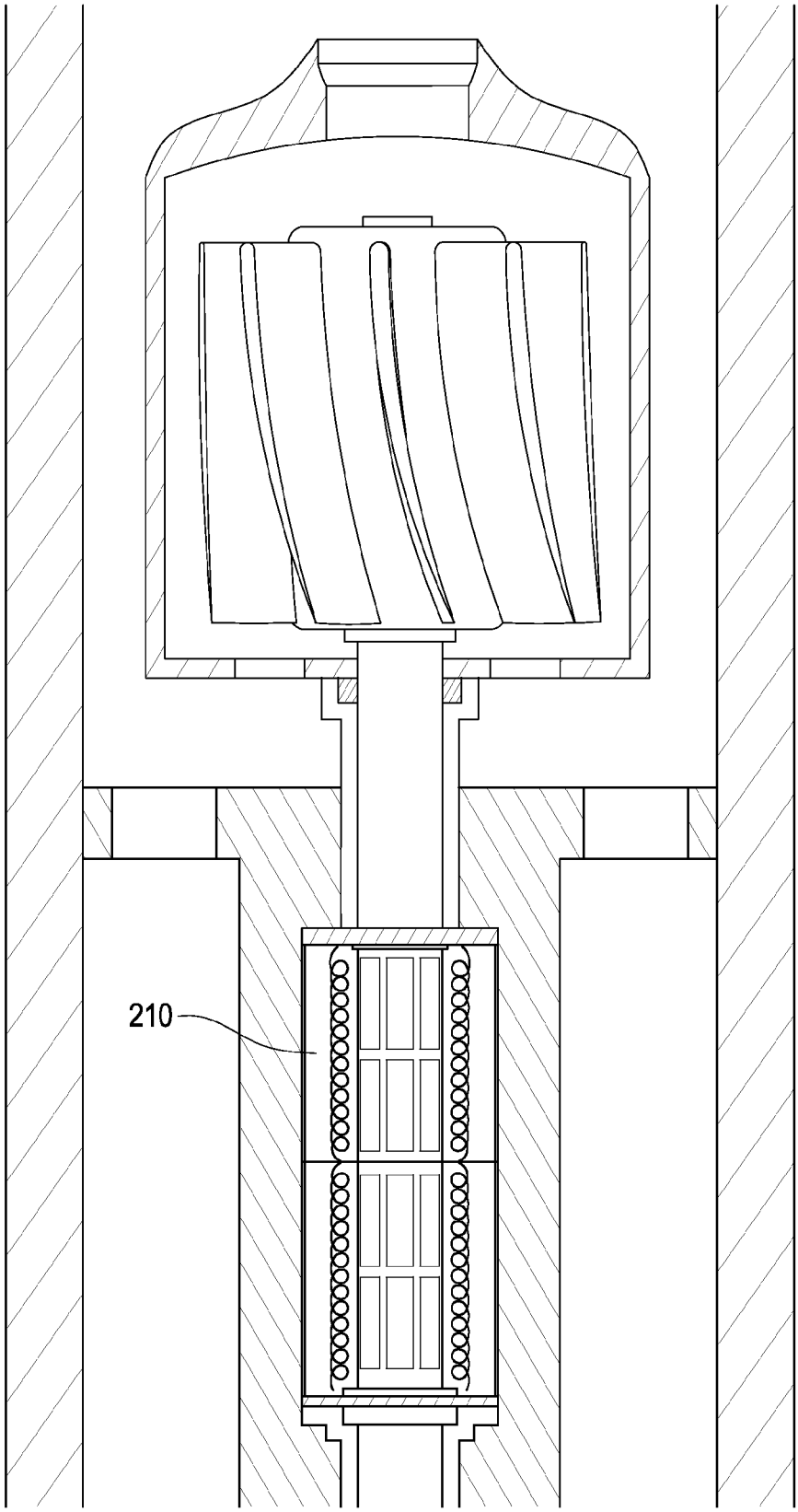
FIG. 7 is a cross-sectional diagram of an embodiment of a downhole tool string component.

The electric motor 210 in some cases may also double as a generator. In such cases the generator may be powered by a turbine as in the embodiment of FIG. 7. The turbine may be disposed within a recess formed in the bore wall with an entry passage and an exit passage to allow fluid to flow past the turbine, causing it to rotate. The turbine may be attached to a generator in electrical communication with the electric motor 210, providing the power necessary to operate the jack assembly. The turbine and/or generator may also be disposed within the bore of the tool string component, which may allow for more power to be generated, if needed.

Figure 8:
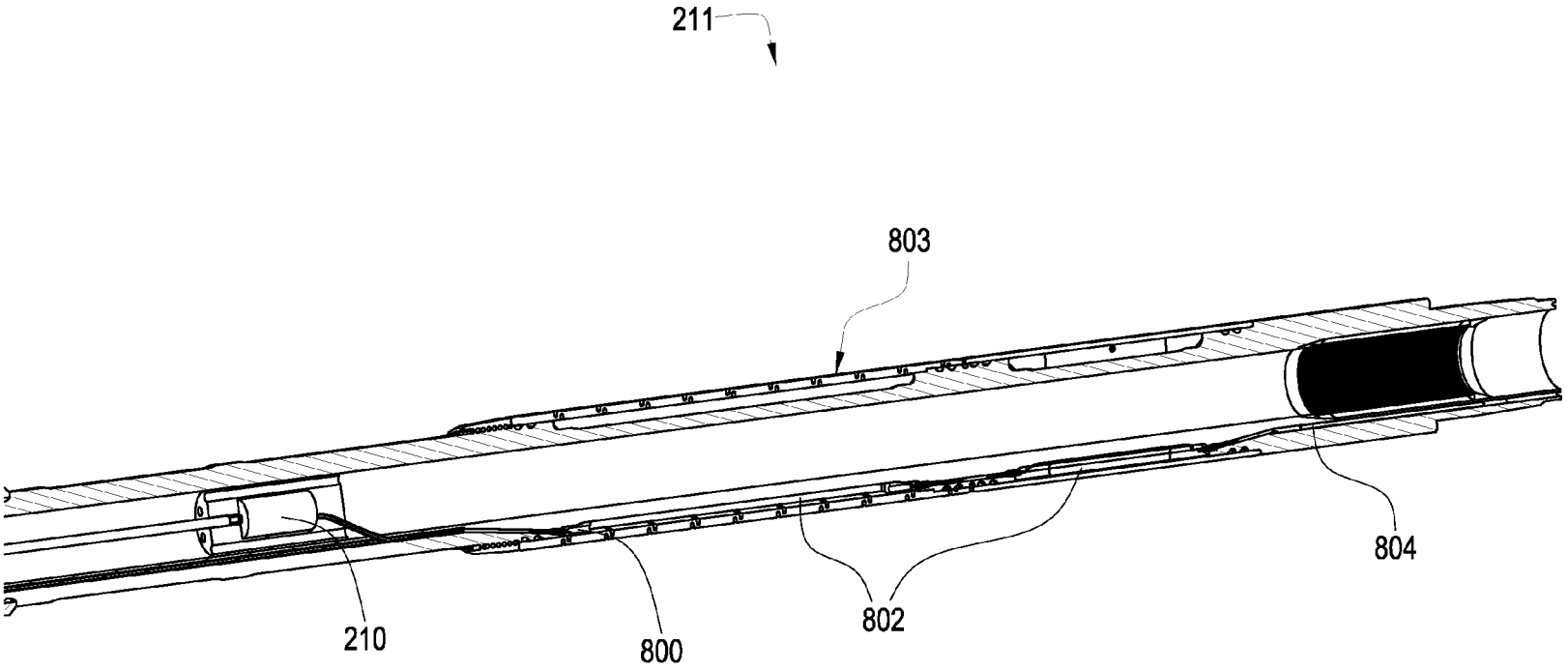
FIG. 8 is a cross-sectional diagram of another embodiment of a bottom-hole assembly.

The electric motor 210 may be in electrical communication with electronics 800, as in the embodiment of FIG. 8. The electronics 800 may be disposed within a recess or recesses formed in the bore wall 213 or in an outer diameter 802 of the tool string component 211. A metal, compliant sleeve 803 may be disposed around the tool string component 211, such as is disclosed in U.S. patent application Ser. No. 11/164,572, now U.S. Pat. No. 7,377,315 and which is herein incorporated by reference for all that it contains. The complaint sleeve may help protect the electronics 800 from harsh downhole environments while allowing the tool string component 211 to stretch and bend.

The electronics 800 may be in electrical communication with a downhole telemetry system 804, such that the electric motor 210 may receive power from the surface or from another tool string component farther up the tool string 100. The electronics 800 may also comprise sensors which measure downhole conditions or determine the position, rotational speed, or compression of the shaft of the jack assembly. The sensors may allow an operator on the surface to monitor the operational effectiveness of the drill bit. The jack assembly 200 may also be part of a closed-loop system, wherein the electronics 800 may comprise logic which uses information taken from the sensors and operates the rotational speed of the motor 210 and/or orientation of the shaft from a downhole assembly. This may allow for a more automated, efficient system.

Figure 9:
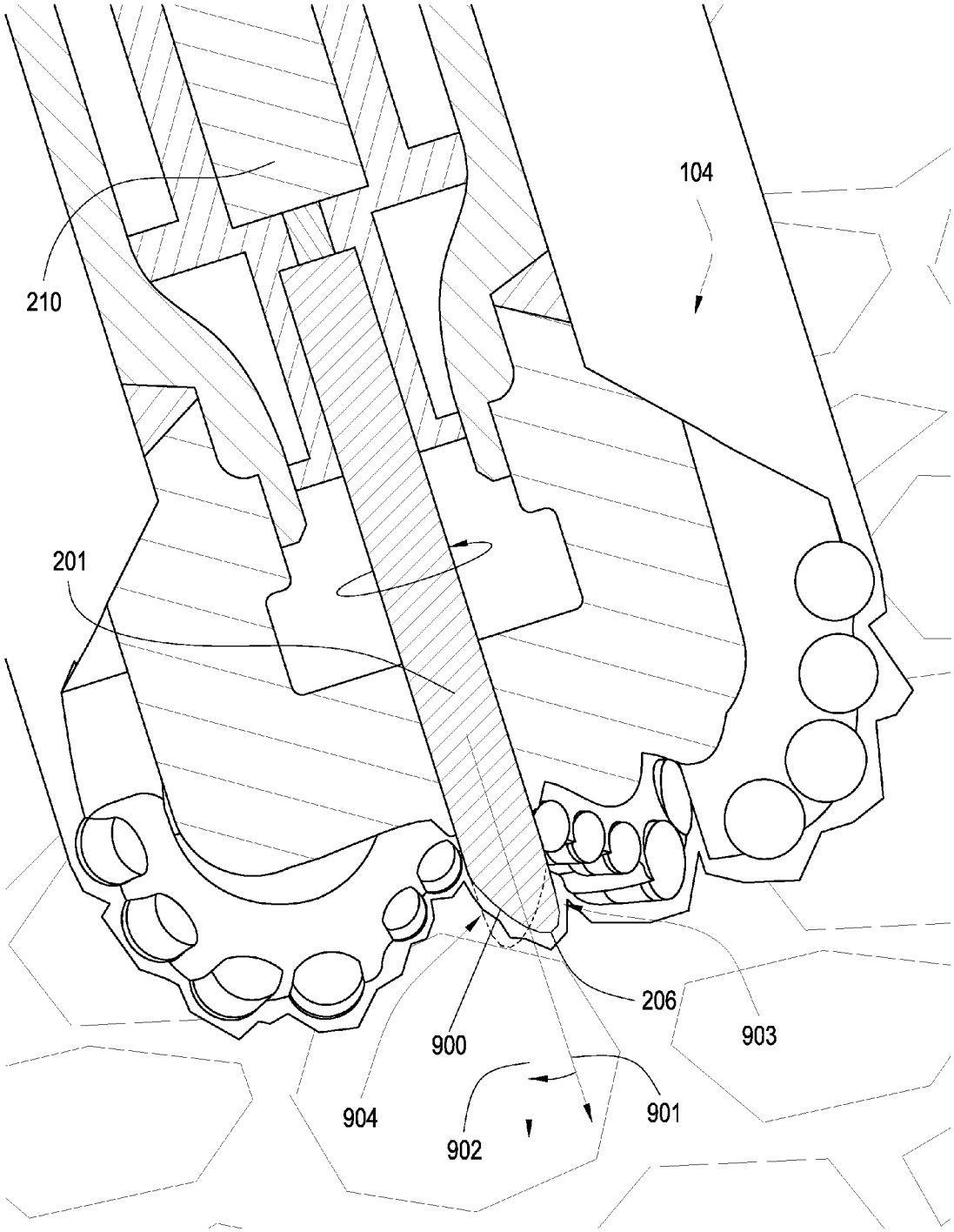
FIG. 9 is a cross-sectional diagram of another embodiment of a drill bit.

The distal end 206 of the shaft 201 may comprise a bias 900 adapted to steer the tool string 100, as in the embodiment of FIG. 9. The electric motor 210 may counter-rotate the shaft 201 with respect to the drill bit 104 such that the shaft 201 remains rotationally stationary with respect to the formation. While rotationally stationary, the bias 900 may cause the drill bit 104 to steer in a desired direction. In order to change the direction from a first direction 901 to a second direction 902, the motor 210 may rotate the shaft from a first position 903 to a second position 904, represented by the dashed outline, such that the bias 900 begins to direct the tool string in the second direction 902. In order to maintain the tool string in a constant direction, the motor 210 may make the shaft 201 rotate with respect to the formation such that the bias 900 does not affect the direction of the tool string.

Figure 10:
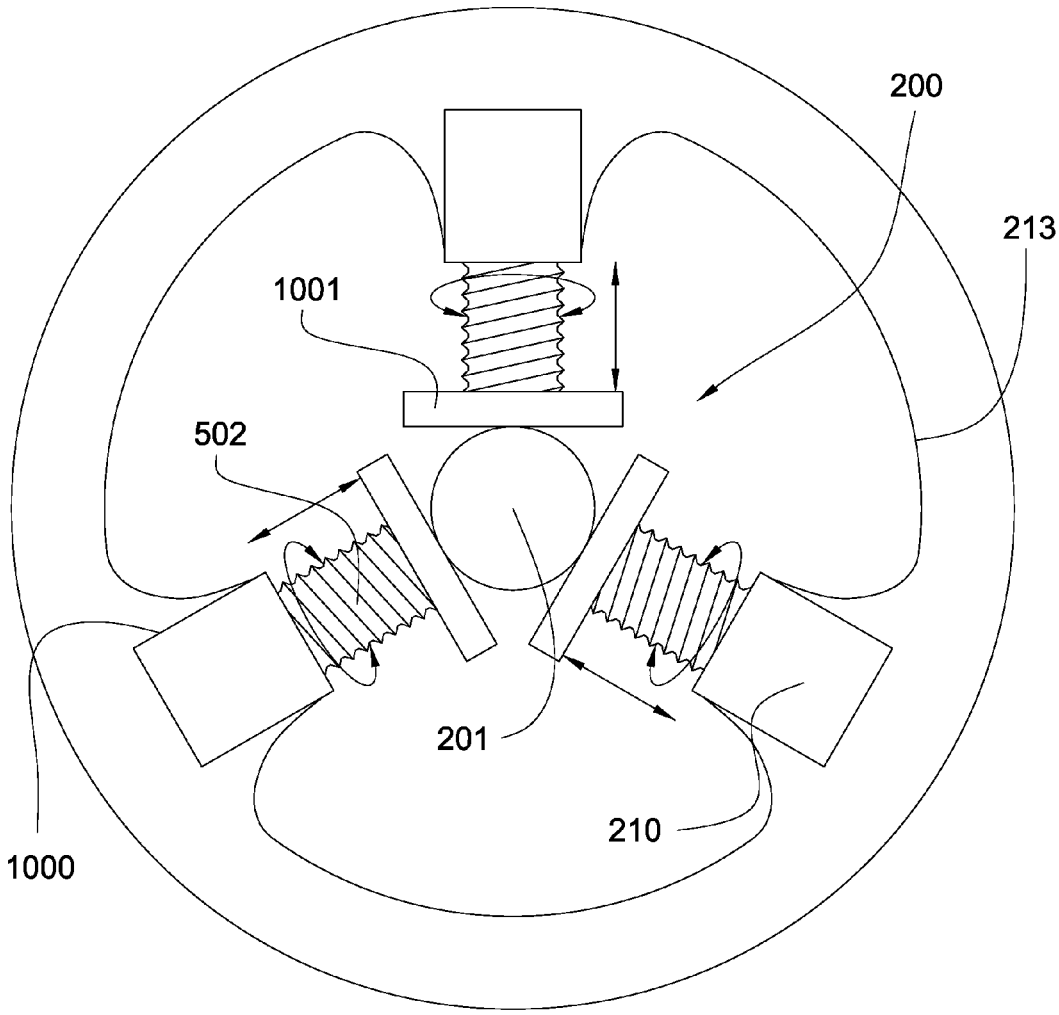
FIG. 10 is a cross-sectional diagram of another embodiment of an electric motor.

The jack assembly 200 may comprise a plurality of electric motors 210 adapted to alter the axial orientation of the shaft 201, as in the embodiment of FIG. 10. The motors 210 may be disposed within open recesses 1000 formed within the bore wall 213. They may also be disposed within a collar support secured to the bore wall. Each electric motor 210 may comprise a protruding threaded pin 502 which extends or retracts according to the rotation of the motor 210. The threaded pin 502 may comprise an end element 1001 such that the shaft 201 is axially fixed when all of the end elements 1001 are contacting the shaft 201. The axial orientation of the shaft 201 may be altered by extending the threaded pin 502 of one of the motors 210 and retracting the threaded pin 502 of the other motors 210. Altering the axial orientation of the shaft 201 may aid in steering the tool string.

Whereas the present invention has been described in particular relation to the drawings attached hereto, it should be understood that other and further modifications apart from those shown or suggested herein, may be made within the scope and spirit of the present invention.

What is claimed is:

1. A drill bit comprising:

a body intermediate a shank and a working face and comprising an axis of rotation;

the working face comprising at least one cutting element and the body comprising at least a portion of a jack assembly;

the jack assembly comprising at least a portion of a shaft disposed within a cavity formed in the body of the drill bit, the shaft comprising a distal end extending from an opening of the cavity formed in the working face; and the jack assembly also comprising an electric motor and/or generator;

wherein the jack assembly is adapted to stabilize the drill bit by indenting the distal end into a formation;

wherein the distal end of the shaft comprises a bias adapted to steer a tool string connected to the drill bit.

2. The bit of claim 1, wherein the bit is a shear bit, a percussion bit, or a roller cone bit.

3. The bit of claim 1, wherein the shaft is coaxial with the axis of rotation.

4. The bit of claim 1, wherein the shaft is rotationally isolated from the drill bit.

5. The bit of claim 1, wherein a seal is disposed around the shaft and in the opening of the cavity formed in the working face.

6. The bit of claim 1, wherein the jack assembly comprises a spring connected to the shaft and the electric motor is in mechanical communication with the spring.

7. The bit of claim 6, wherein the electric motor is adapted to change the compression of the spring.

8. The bit of claim 1, wherein the electric motor is a stepper motor.

9. The bit of claim 1, wherein the electric motor is an AC motor, a universal motor, a three-phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly-fed motor, or combinations thereof.

10. The bit of claim 1, wherein the shaft is in mechanical communication with the electric motor.

11. The bit of claim 10, wherein the electric motor is adapted to axially displace the shaft.

12. The bit of claim 1, wherein at least a portion of the electric motor is disposed within the chamber.

13. The bit of claim 1, wherein the electric motor is in communication with a downhole telemetry system.

14. The bit of claim 1, wherein the electric motor is adapted to counter-rotate the shaft with respect to the rotation of the bit.

15. The bit of claim 1, wherein the electric motor is in communication with electronic equipment disposed within a bottom-hole assembly.

16. The bit of claim 15, wherein the electronic equipment comprises sensors.

17. The bit of claim 15, wherein the electric motor is part of closed-loop system adapted to control the orientation of the shaft.

18. The bit of claim 1, wherein the electric motor is powered by a turbine, a battery, or a power transmission system from the surface or downhole.

19. The bit of claim 1, wherein the distal end comprises a hard material selected from the group consisting of polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond, cubic boron nitride, chromium, titanium, matrix, diamond impregnated matrix, diamond impregnated carbide, a cemented metal carbide, tungsten carbide, niobium, or combinations thereof.

* * * * *